US005846352A

United States Patent [19]

Kretchmer

[11] Patent Number: 5,846,352

[45] Date of Patent: Dec. 8, 1998

[54] HEAT TREATMENT OF A PLATINUM-GALLIUM ALLOY FOR JEWELRY

[76] Inventor: Steven Kretchmer, Rte. 23A, Palenville, N.Y. 12463

[21] Appl. No.: 754,880

[22] Filed: Nov. 22, 1996

[51] Int. Cl.[6] ..... C22C 5/04

[52] U.S. Cl. ..... 148/678; 148/538; 148/430; 148/405

[58] Field of Search ..... 148/678, 538, 148/430, 405; 420/466; C22C 5/04

[56] References Cited

U.S. PATENT DOCUMENTS

| | | | |
|---|---|---|---|
| 4,165,983 | 8/1979 | Bourne et al. | 420/466 |
| 4,324,777 | 4/1982 | Anderson | 423/579 |
| 4,822,699 | 4/1989 | Wan | 429/40 |
| 5,084,108 | 1/1992 | Kretchmer | 148/678 |

FOREIGN PATENT DOCUMENTS

| | | |
|---|---|---|
| 57-145950 | 9/1982 | Japan . |
| 61-272333 | 12/1986 | Japan . |
| 61-272334 | 12/1986 | Japan . |
| 61-272335 | 12/1986 | Japan . |
| 61-272337 | 12/1986 | Japan . |
| 62-56544 | 3/1987 | Japan . |

OTHER PUBLICATIONS

Japanese Application Patent Abstract No. JP 02–250946, filed Oct. 8, 1990.

Japanese Application Patent Abstract No. JP 61–272337A, filed Dec. 2, 1986.

Japanese Application Patent Abstract No. JP 61–272336, filed Dec. 2, 1986.

Japanese Application Patent Abstract No. JP 61–270351 A, filed Nov. 29, 1986.

Japanese Application Patent Abstract No. JP 61–270350 A, filed Nov. 29, 1986.

Japanese Application Patent Abstract No. JP 61–270349A, filed Nov. 29, 1986.

Japanese Application Patent Abstract No. JP 57–210936A, filed Dec. 24, 1982.

*Primary Examiner*—Margery Phipps

*Attorney, Agent, or Firm*—Pennie & Edmonds

[57] ABSTRACT

A platinum alloy containing 1 to 9 percent gallium and minor amounts of property enhancing additives, eg. up to 3% Pd. This alloy can be heat-treated to a Vickers hardness that is increased by at least over 25% beyond its initial, untreated value and typically to at least over 300 HV. The heat-treatment process includes the steps of solution-treating the alloy, followed by quenching and a hardening heat-treatment to achieve the desired hardness and strength. The alloy is useful as a component of jewelry, art objects or related articles.

11 Claims, No Drawings

HEAT TREATMENT OF A PLATINUM-GALLIUM ALLOY FOR JEWELRY

TECHNICAL FIELD

The present invention relates to platinum-gallium alloys which are heat-treatable to high strength and hardness for use in jewelry, art objects and related articles.

BACKGROUND ART

It is known in the jewelry-making art that the hardness and strength of alloys can be increased by cold deformation. That is, it is known how to work gold and platinum alloys by various forging processes to harden and increase yield strength to create stronger components, and for the use of exerting spring pressure. Increased strength is necessary for many types of durable structural parts such as lighter chains, pin stems, and thinner stampings. Spring pressure can be applied to form spring components for clasps, closures, wires, and springs. Even rings, pendants, bracelets, can mount center gemstones by compression spring power. The necessary pressure, in the latter examples, is supplied by the springiness inherent in the structure of the worked precious metal mounting itself.

It is also known to those interested in the metallurgy of precious metals that many gold alloys and certain platinum alloys can be hardened by heat-treatments to increase their hardness' and yield strengths, sometimes even more than is possible through cold working. In this regard, U.S. Pat. No. 5,084,108 discloses a heat-treatment process for increasing the strength of certain alloys specifically for use as compression-spring gemstone mountings.

Platinum is a precious metal and is relatively expensive. Platinum for fine jewelry is sold in high concentrations of over 90% and, by law, must be hallmarked accordingly. Platinum alloys are desirable for their neutral color when combined with gems, they are hypo-allergenic, they have high tensile strength, and a pleasurable heft due to its high-density. In America, platinum alloys for jewelry manufacturing traditionally have concentrations of over 90 percent platinum and contain small amounts of iridium or ruthenium. There has been a recent introduction of platinum-cobalt alloys for casting alloys that are somewhat harder than the traditional iridium or ruthenium platinum alloys. Although work-hardenable, they are permanently softened by heat when soldering or using other metalworking techniques in jewelry manufacturing. Platinum-cobalt alloys do not respond to heat-treatments.

Various gallium containing platinum alloys are known in the field of metallurgy. These alloys include 89–98.9% Pt, 1.1–11% Ga; 85–95% Pt, 2–4% Ga, 3–12% Cu; 95% Pt, 2–2.5% Ga, 2.5–3% Au; and 95% Pt, 2–3% Ga, 1–3% Au, 0–2.5 In. To the present inventor's knowledge, however, none of these alloys have been heat-treated to increase strength and hardness for use as jewelry components.

There are known heat-treatable platinum alloys such as 90% platinum-10% gold, but these alloys have undesirable characteristics for jewelry work. A 90% Pt, 10% Au alloy tends to crack, is extremely difficult to draw into wire or roll, and does not cast well by known jewelry-making techniques. Platinum (90%+)/copper, used in Europe, does not significantly respond to heat-treatments, and only can be strengthened by a few percent.

Due to the potential improvements in properties and performance of such heat-treated alloys, there is a need for additional alloys that are heat-treatable for use in jewelry and art applications. The present invention provides one alloy family for this purpose.

SUMMARY OF THE INVENTION

The present invention relates to a jewelry component made of a platinum alloy which includes about 1 to 10 weight percent gallium. Advantageously, the alloy can include any one of a number of property enhancing agents, including a deoxidizing agent, grain reducing agent, a viscosity decreasing agent or a color variation agent. Thus, the alloy would typically include up to about 3 weight percent of one or more of iridium, palladium, cobalt, copper, gold, indium, silver, or other elements. This alloy is generally heat-treated to a Vickers hardness of at least about 300. Preferably, gallium is present in an amount of about 2 to 7 weight percent, and the Vickers hardness is between about 325 and 385. The number and amount of the other additives may vary, but it is especially advantageous to include iridium in the alloy in an amount of between about 0.1 and 1.5 weight percent.

The invention also relates to a method for making a jewelry component, which comprises formulating one of the platinum alloys described above, heat-treating the alloy to-provide a Vickers hardness of at least about 300 or to at least increase the initial Vickers hardness of the alloy by about 25%, and then utilizing the heat-treated alloy as a component of jewelry. In this method, the two stage heat-treating operation may include solution-treating the alloy at a temperature of at least about 1700° F, quenching the solution-treated alloy to a temperature of below about 200° F, and then, hardening the quenched alloy at at least 900° F for a sufficient time to achieve the desired hardness. Preferably, the solution-treating temperature is at least 1800° F, the alloy is held at that temperature for at least 10 minutes, and the solution-treating step is conducted in an inert, non-oxidizing or anti-oxidizing environment. The solution-treated alloy is then quenched in water that is at room temperature or colder. Also, the hardening treatment is preferably conducted by heating the alloy in an inert, non-oxidizing or anti-oxidizing gas atmosphere for at least 30 minutes at 1100° to 1200° F. The hardened alloy is generally cooled to room temperature to form the jewelry component.

The alloy may be formed into a desired shape prior to the two-stage heat-treating operation. Such operations are many and include casting or fabricating. Some examples of fabrication can be by rolling of the alloy into a sheet, drawing a wire, molding, casting, forging, stamping or constructing the object or shape useful as a jewelry component. It is also useful to process the hardened alloy to remove or prevent surface oxidation. One method to remove surface oxidation is by abrasion, although as previously mentioned, the alloy may be shielded during the heat-treating operations to prevent surface oxidation.

DESCRIPTION OF THE PREFERRED EMBODIMENTS

The invention of this particular high-concentration platinum alloy hardened significantly by heat-treatment is extremely appropriate for the manufacturing of jewelry, allowing for many advantages to the jewelry manufacturer over presently utilized alloys, such as:

1) Thinner, lighter constructions and castings, possessing significantly lowered weight and costs.

2) Springier clasps and mechanisms, not previously possible to construct.

3) Strengthening of delicate fabrications such as prong setting after construction.

4) Higher polish, much easier to achieve, due to increased hardness.

5) Lower casting temperatures than previously known.

6) Lower costs with alloy additions other than traditional iridium or ruthenium.

7) Expanded jewelry design possibilities.

The invention is preferably related to platinum-gallium alloys that can be cast to a desired form or worked by traditional fabrication methods in an annealed state, then heat-treated and age-hardened to significantly increase their yield strengths so that they become hardened and spring-like. The alloys can be used for a wide variety of jewelry components, such as rings, clasps, spring parts, even compression-spring settings for gemstones, and the like. These alloys can be repeatedly annealed and heat-treated/age-hardened, and will actually increase in strength at room temperature over time.

As used herein, the term "age-hardening" is essentially synonymous with the term "precipitation hardening" which results from the formation of tiny particles of a new constituent (phase) within a solid solution. The presence of these particles create stress within the alloy and increase its yield strength and hardness. See, B. A. Rogers, "The Nature of Metals", p.320 (Iowa State University Press, 1964); H. W. Polock, "Materials Science and Metallurgy", p. 266 (Reston Pub. Inc. 1981) and "The Metals Handbook", pp.1–2 (Am. Soc'y Metals, 1986).

A multitude of forms for jewelry components from the present invention of platinum-gallium alloys can be hardened by heat-treatments and utilized. Mountings can hold stones by significant compression-spring power.

In their annealed/softened state the alloys can be worked by standard jewelry-making techniques: they can be rolled, drawn, soldered to, shaped, bent, stamped, etc. These alloys can be applied to a variety of designs for springs, gemstone mountings in rings, pendants, bracelets, chains, precious metal art objects, and the like.

It should be noted that in designing for structure of the jewelry or art object, the smallest cross-sectional area and shape of a component is taken into account. It is possible to adapt the design of the alloy to almost any configuration. The basic forms of these designs can vary, from simple sheet, to ring-shapes and more complex helixes, v-shapes, and the like. Objects can be wire, sheet, springs of all types, pendants, chain-links, brooches, and a multitude of others. Standard jewelry soldering techniques can be applied and repairs requiring heat can be carried out. The alloys can be shaped, bent, built onto, annealed, and when the piece is done, the spring power and hardness can be regained by heat-treatment. The alloy can be used to add durability to any jewelry component. Due to its superior hardness, its finish will also last longer.

The hardness and strength of the alloys are increased by a simple heat-treatment. The piece need not be forged to shape, like a coin is struck, or a ring pounded on a mandrel with a hammer, etc. Rather, the piece can be cast to any desired shape, or worked to its finished form before spring power or hardness is increased in it.

Not only does the technique of the present invention allow for more possibilities than prior art work-hardening techniques for obtaining hardness or spring power, but the equipment involved is more economical. Instead of presses, dies, and drop-hammers to create spring power for a production of pieces, a simple electric furnace, hot oil bath, or the like, is all that is required.

There are three basic steps when using construction methods to make components of heat-treatable precious metal hardenable alloys according to the present invention. First, after the ingot is poured, the alloy should be cold-work reduced in cross sectional dimension before construction is begun, that is, it must be rolled or drawn down (broken down). Second, after the piece is constructed by standard jewelry fabrication techniques and is in its final form, the piece must be completely solution-treated. Third, it must be hardened by heat-treatment in an oven for a certain amount of time (controlled precipitation). It can then be cooled to ambient temperature.

In the case of as-cast shapes made of heat-treatable alloys, there are two basic steps to increase their spring power according to the present invention. After it is in its final form, the piece must first be completely solution-treated. Second, it must be hardened by heat-treatment in an oven for a certain amount of time (controlled precipitation). It can then be cooled to ambient temperature.

The invention is created by the additions of the element gallium to platinum. Even additions of less then 3 percent gallium allow significant, beneficial hardening effects by heat-treatment. The addition of gallium in small quantities to platinum costs significantly less than iridium or ruthenium and creates an unexpectedly unique and advanced product for jewelry manufacturing.

Traces of other elements can add other features when desired. The additional of less than one percent of iridium, for example, can act as a grain-refiner, reducing grain-growth. Additions of trace quantities of elements such as palladium, cobalt, copper and others will vary the metallurgical structure and therefore the characteristics of the alloy. Each of these elements can be added in trace amounts up to about 2% by weight of the alloy.

The platinum-gallium alloy is preferably melted and blended together by induction heating in appropriate crucibles for platinum alloys, and poured through water to create grain-shot than can be dried, weighed and used for casting.

Any forms made in wax can be easily cast by well-known traditional lost-wax casting techniques for platinum. significantly, these platinum-gallium alloys cast easier than any other previously known platinum alloy and are more energy efficient, due to their relatively low melting temperature. This lower temperature alloy also allows a lower mold temperature, decreasing defect rate due to shrinkage porosity, investment cracking, inclusions, and contaminations that occur more readily at highly-elevated temperatures.

Ingots for sheet or wire fabrication can easily be cast by either investment lost-wax casting methods or into ingot molds for platinum. The alloy can be rolled to approximately a 30 to 40 percent reduction before needing an annealing procedure.

The platinum-gallium alloy is annealed at a temperature around 1800° F by either furnace or torch to an orange-yellow, followed by an immediate quench in water.

There is slight surface oxidation that appears as a darkening or haze that forms on the surface of this alloy during high-temperature operations and can be prevented by dipping the alloy in boric-acid/alcohol solution before bringing it to high temperature. Many known method for prevention of surface oxidation work well such as utilizing a shielding-gas or stainless-steel foil-wrap in combination with the boric-acid dip. Otherwise, the oxidation can simply be removed by abrasion with emery paper or polishes.

The hardening of this alloy is a two-step procedure. Solution-treating is necessary previous to the hardening heat-treatment, to maximize hardening and its uniformity.

The alloy in cast form, in the form of sheet or wire stock, or in the form as a finished piece can be solution-treated at temperature near 1800° F in a furnace, preferably atmosphere-controlled with shielding-gas. Times vary for differing thickness. For an example, thirty minutes is an adequate amount of time for wire of over two millimeters in diameter. The alloy must be immediately quenched in water from the furnace.

The second heat-treatment, the hardening step of the platinum-gallium alloy involves heating the piece at approximately 1200° F for a period of one hour in a furnace, preferably atmosphere-controlled with shielding-gas. It can be allowed to air cool outside the furnace.

The shielding gas can be any of the non-oxidizing inert gasses, such as argon, nitrogen, or mixtures thereof; anti-oxidizing gasses such as hydrogen, carbon monoxide, or "forming" or "cracked ammonia" gas (nitrogen with a few percent of hydrogen). The piece can also be protected from oxidation by enveloping them with commercially available heat-treating wraps.

EXAMPLES

The following examples illustrate the most preferred embodiments of the platinum-gallium alloys of the invention.

Example 1

A 95% platinum, 5% gallium alloy was made and then cast into a wire. A solution treatment of 1800° F for 30 minutes under argon gas in conducted, followed by a quench into room temperature water. Next, a hardening step is conducted where the quenched alloy is heated to 1200° F for about 1 hour under argon gas. The alloy is then allowed to cool to room temperature. Vickers hardness measurements are taken on this material after the solution treatment, and after the hardening step. These values are reported in Table 1. The hardening step raises the Vickers hardness about 70%.

Example 2

The same alloy as in example 1 is rolled to a flat strip before being subjected to the same solution treatment and hardening steps. The Vickers hardness measurements for this alloy is also shown in Table 2. A hardness increase of about 75% is seen.

An increase in hardness implies an increase in strength and elasticity, as well as a reduction in ductility. Increases in hardness of at least about 25% to 50% are useful for many application, although even higher increases can be obtained as shown in these examples.

TABLE 1

| | Vickers Hardness (500 gm load) | |
|---|---|---|
| Alloy (Form) | Range | Average Hardness (HV) |
| Cast—Solution Annealed | 200–222 | 210 |
| Cast—Hardened | 340–385 | 361 |
| Rolled—Solution Annealed | 204–385 | 213 |
| Rolled—Hardened | 350–384 | 374 |

The foregoing examples are intended to illustrate typical improvements in strength and hardness that can be obtained using the present platinum-gallium alloys and the novel heat-treatment process disclosed herein. Of course, higher or lower values can be attained by conducting routine tests. Thus, it is understood that changes and variations can be made in the foregoing without departing from the scope of the invention which is defined in the following claims.

What is claimed is:

1. A method for making jewelry, which comprises:

formulating a platinum alloy which consists essentially of at least about 95 weight percent platinum, about 1 to 5 weight percent gallium, and an additional alloying element of palladium in an amount effective as a property enhancing agent but less than about 3 weight percent, said alloy having an initial Vickers hardness;

heat-treating the alloy to increase the Vickers hardness by at least about 25% but to not greater than a Vickers hardness of 385; and utilizing the heat-treated alloy as a component of jewelry.

2. The method of claim 1 wherein the property enhancing agent is a deoxidizing agent, a grain reducing agent, a viscosity decreasing agent or a color variation agent; and the heat-treating operation comprises solution-treating the alloy at a temperature of at least about 1700° F; quenching the solution-treated alloy to a temperature of below about 200° F; and hardening the quenched alloy at at least 900 F for a sufficient time to achieve the desired hardness.

3. The method of claim 2 wherein the solution-treating temperature is a least 1800° F, the alloy is held at that temperature for at least 10 minutes, the solution-treating step is an annealing step conducted in an inert, non- or anti-oxidizing environment, and the annealed alloy is quenched in water.

4. The method of claim 2 wherein the hardening heat-treatment is conducted by heating the alloy in an inert, non- or anti-oxidizing gas atmosphere for at least 30 minutes at about 1100° to 1200° F.

5. The method of claim 4 wherein the hardened alloy is cooled to room temperature.

6. The method of claim 1 which further comprises forming the alloy into a desired shape of the jewelry component prior to the heat-treating operation.

7. The method of claim 6 wherein the forming operation includes casting, forging, drawing, stamping or rolling the alloy.

8. The method of claim 1 which further comprises treating the hardened alloy to remove or prevent surface oxidation.

9. The method of claim 8 wherein the alloy is shielded to prevent surface oxidation.

10. The method of claim 6 wherein the alloy is formed into a sheet, wire, or cast object.

11. The method of claim 2 wherein the annealed object is formed into a shape useful as a jewelry component before the quenching step.

* * * * *